US005147057A

United States Patent [19]

Marshall et al.

[11] Patent Number: 5,147,057

[45] Date of Patent: Sep. 15, 1992

[54] INVERTED CLOSURES FOR BEVERAGE CONTAINERS

[75] Inventors: Dennis L. Marshall, Wauwatosa; Bora Tekkanat, Milwaukee; Bryan L. McKinney, Mequon, all of Wis.

[73] Assignee: Hoover Universal, Inc., Plymouth, Mich.

[21] Appl. No.: 599,501

[22] Filed: Oct. 18, 1990

[51] Int. Cl.[5] ..... B65D 41/32

[52] U.S. Cl. ..... 220/268; 215/253; 215/305; 220/269; 220/254; 220/335; 220/705; 220/709

[58] Field of Search ..... 215/253, 255, 258, 298, 215/305; 220/213, 212, 268, 269, 266, 335, 90.4, 90.2, 90.6

[56] References Cited

U.S. PATENT DOCUMENTS

| | | | |
|---|---|---|---|
| 1,437,572 | 12/1922 | Vons | 215/298 |
| 2,662,656 | 12/1953 | Beaubaire et al. | 215/270 |
| 2,770,383 | 11/1956 | Livas | 215/305 X |
| 3,034,680 | 5/1962 | Steinberg | 220/266 X |
| 3,332,565 | 7/1967 | Elser | 215/255 |
| 3,355,060 | 11/1967 | Reynolds et al. | 220/90.4 X |
| 3,415,405 | 12/1968 | Rausing et al. | 215/253 |
| 3,797,696 | 3/1974 | Dibrell | 220/90.4 |
| 3,806,023 | 4/1974 | Barnett | 220/90.2 X |
| 3,874,554 | 4/1975 | Chang | 220/90.2 |
| 3,923,193 | 12/1975 | Wells et al. | 220/269 |
| 3,927,794 | 12/1975 | Erdman | 220/268 |
| 3,929,251 | 12/1975 | Urmston | 220/268 |
| 4,113,135 | 9/1978 | Yamazaki | 220/268 |
| 4,184,604 | 1/1980 | Amberg et al. | 220/254 |
| 4,190,174 | 2/1980 | Haimowitz | 220/254 |
| 4,245,752 | 1/1981 | Prueher | 220/266 |
| 4,266,688 | 5/1981 | Reid | 220/273 |
| 4,345,695 | 8/1982 | Galloway | 220/254 |
| 4,350,260 | 9/1982 | Prueher | 220/254 |
| 4,784,283 | 11/1988 | Cantu | 220/269 |

FOREIGN PATENT DOCUMENTS

| | | | |
|---|---|---|---|
| 2363546 | 6/1974 | Fed. Rep. of Germany | 215/255 |

*Primary Examiner*—Stephen Marcus
*Assistant Examiner*—Vanessa Caretto
*Attorney, Agent, or Firm*—Harness, Dickey & Pierce

[57] ABSTRACT

A single service container having a closure cap with a recessed portion extending generally interiorly of said container. A tab is defined by a score line which, upon deflection of a an actuating member on the cap, substantially separates from the remainder of the recessed portion forming an opening in the cap. Once the tab has been separated, it is deflected through the opening and prevented from obstructing the opening by the actuating member being positioned in an interference relationship between the interior of the container, adjacent the opening, and the tab.

4 Claims, 3 Drawing Sheets

FIG. 4
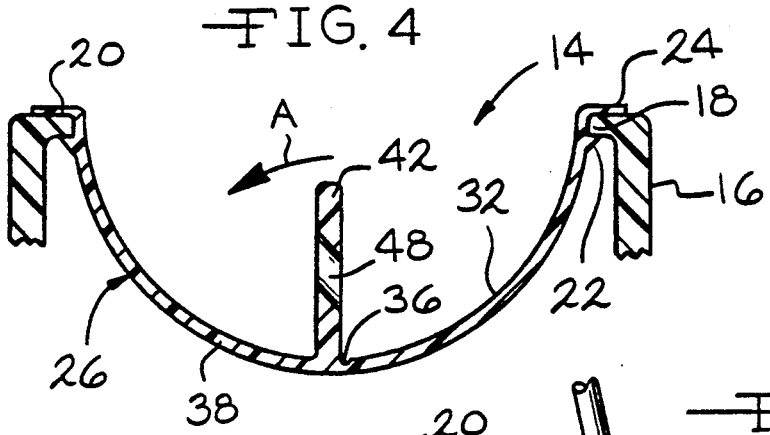
FIG. 5
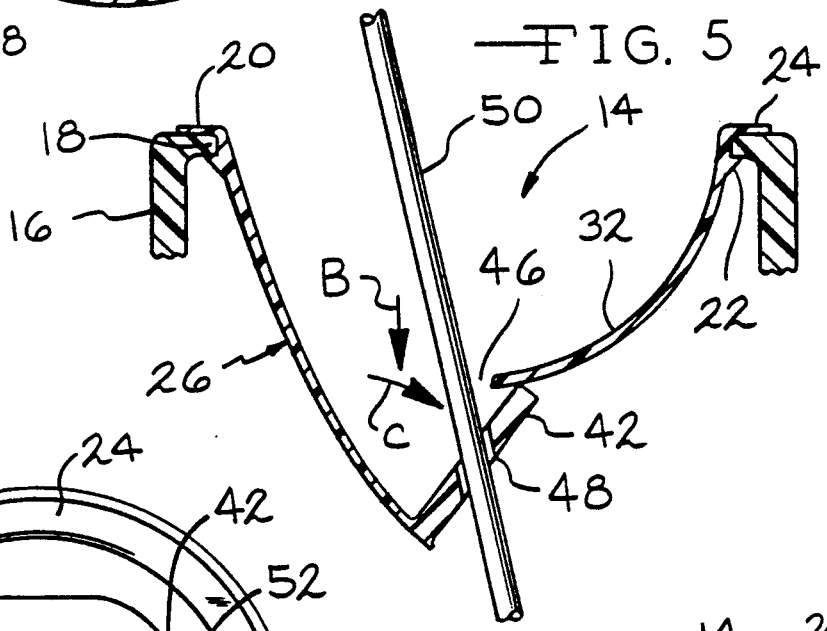
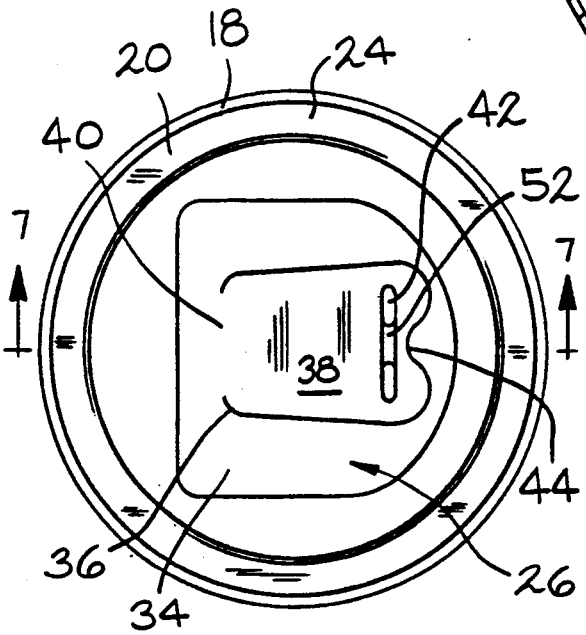
FIG. 6
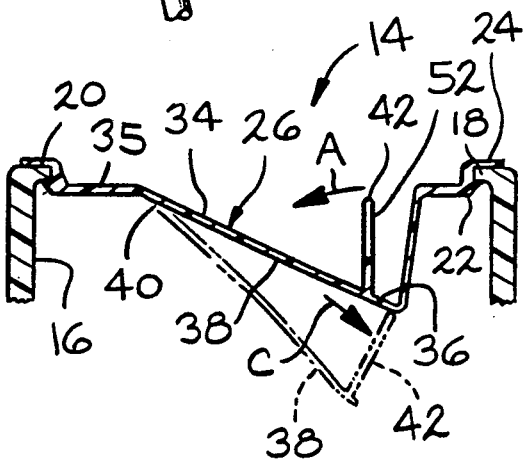
FIG. 7

INVERTED CLOSURES FOR BEVERAGE CONTAINERS

BACKGROUND AND SUMMARY OF THE INVENTION

The present invention relates generally to containers and more particularly to beverage containers having closures with a portion that generally extends toward the interior of the container.

Today, consumers have available a wide selection of beverage container types. However, at least three broad classes of containers may be carved out of this selection. One class encompasses those containers which require a tool for opening. A second includes those which do not require a tool for opening. A third class of containers is one where a inherent opening tool is formed thereon. Each of the above classes is further composed of a multitude of subclasses. The present invention itself is directed to a beverage container which is opened by using an inherent tool.

Inherent tools themselves come in a variety of styles. One group includes the "tear-off" tabs or tops. While the containers can be constructed out of various materials including paper, plastics and/or metals, the "tear-off" tabs are generally either formed integrally with the container top or adhesively secured over an opening therein. While their popularity has waned in recent times, one example of such a container is the carbonated beverage can having a tear or pull tab that completely separates from the container during opening.

The successor to the pull tab container has been the "pop top" container. Again, this container is most commonly employed with carbonated beverages. However, it differs from the above mentioned container in that the tab is only partially severed from the container during opening.

While only two types of containers having inherent tools have been mentioned above, numerous variations exist. Some of these containers are used for liquids, as above, while others enclose solid materials.

The present invention is a container having an inverted closure. In otherwords, the closure includes a portion which generally extends from the mouth toward the interior of the container. The inverted portion includes a tab which is partially separable from the remainder of the closure by fracturing a score line that defines the tab. By employing the aid of an integral lever, which can be readily actuated by finger pressure, the score line is fractured. Upon fracturing of the score line, the tab is deflected interiorly of the container, through the opening now defined by the fractured score line. The lever is then moved into an interference relationship with a portion of the closure itself to prevent the tab from obstructing the opening during consumption.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 4 is a sectional view taken substantially along line 4—4 in FIG. 2 of a portion of the closed container;

FIG. 5 is a sectional view substantially similar to FIG. 4 and illustrates the lever maintaining the tab in its open position and also having a straw inserted therethrough;

FIG. 6 is a plan view of a second embodiment of this invention;

FIG. 7 is a section view taken generally along line 7—7 in FIG. 6;

DETAILED DESCRIPTION OF THE PREFERRED EMBODIMENTS

Figure 1:
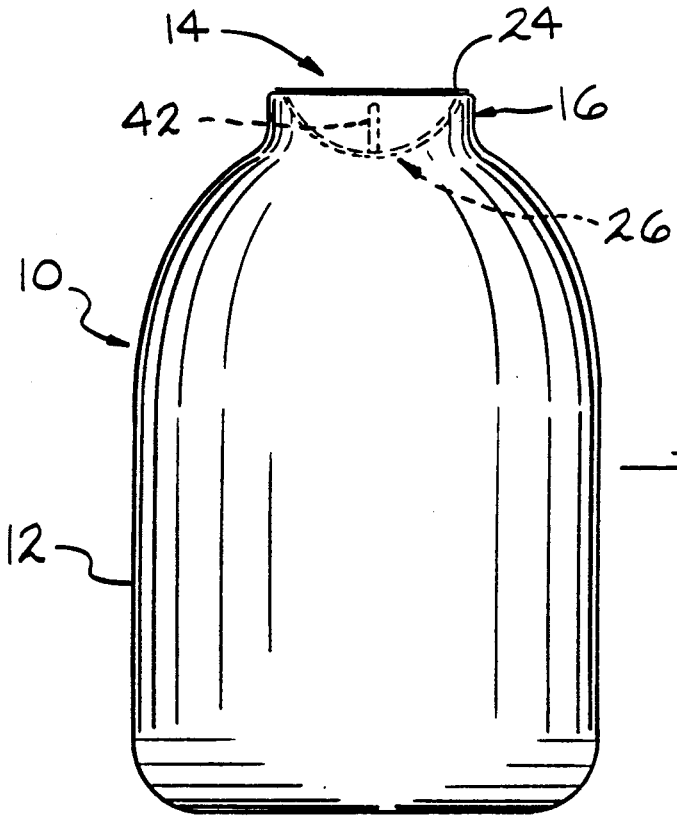
FIG. 1 is a side elevational view of a container incorporating the principles of the present invention.
Figure 2:
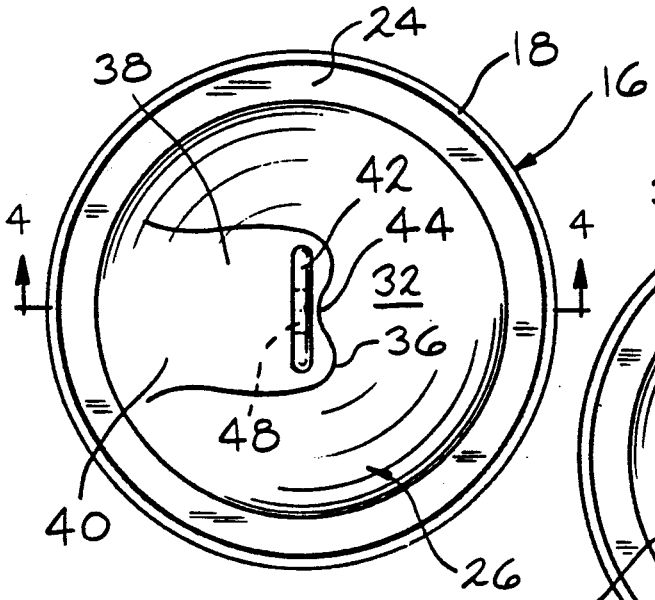
FIG. 2 is a plan view of the closure of the container seen in FIG. 1 prior to opening.
Figure 3:
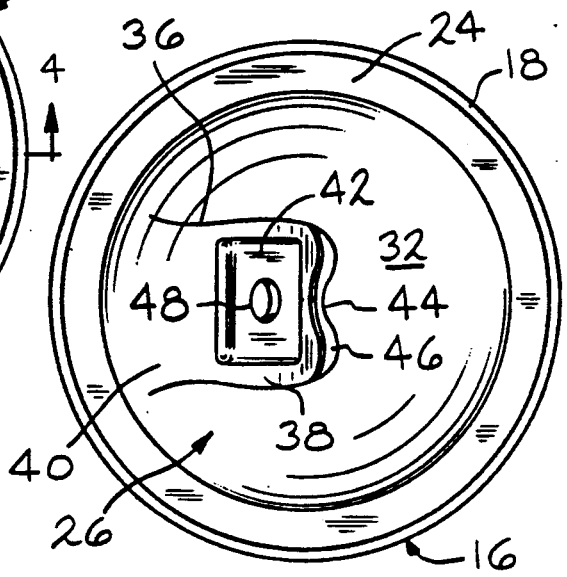
FIG. 3 is a plan view of the closure of the container seen in FIG. 1 partially opened.

Now with reference to the drawing, a container embodying the principles of the present invention is generally designated at 10 in FIG. 1. The container 10 includes a hollow body or bottle 12 and a closure cap 14 which is sealingly engaged or mounted to a mouth 16 formed in the upper end of bottle 12.

The container 10 of the present invention may be used to enclose a variety of contents including solids. However, it is believed that the container 10 will exhibit its most useful attributes while having beverages disposed therein. Such beverages may be of the various types known in the industry, including hot-fill beverages, cold-fill beverages and carbonated beverages.

As required by the particular beverage application, the bottle 12 may exhibit various structural features. The bottle 12 and cap 14 may also be constructed out of a variety of materials including metals, such as aluminum, and plastics, such as polyethylene terepthalate (PET).

Three particular embodiments of the present invention are disclosed herein. For the sake of clarity and convenience, like elements will be designated with like numerals.

As seen in FIGS. 4, 5 and 7, the cap 14 is secured to the bottle 12 by mounting it to a radially inward ledge 18 extending from the mouth 16. The upper and lower surfaces of the ledge 18 are sealingly engaged with a pair of radially outward fingers 20 and 22 which circumscribes the perimeter of the cap 14. In this manner, the top finger 20 forms a generally annular ring 24 that circumferentially engages the top of the annular ledge 18.

Depending upon the material used for the container 10, the fingers 20 and 22 can be sealed to the ledge 18 in various ways. If the container is constructed of metal, the fingers 20 and 22 may be sealed and secured to the ledge 18 through welding, soldering, crimping or other known methods. If the container 10 is constructed of PET, the fingers 20 and 23 may be attached to the ledge 18 through adhesives, sonic welding, spin welding, heat sealing or other method known within the industry.

Figure 8:
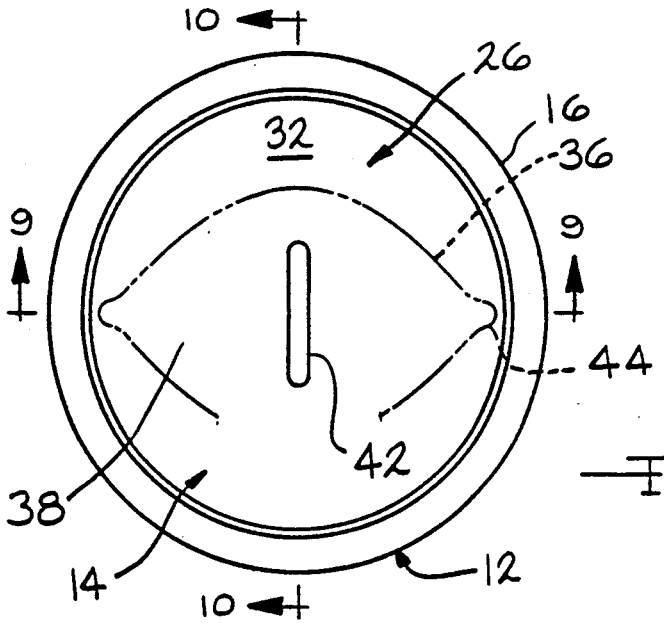
FIG. 8 is a plan view of a third embodiment of a container incorporating the principles of the present invention.
Figure 9:
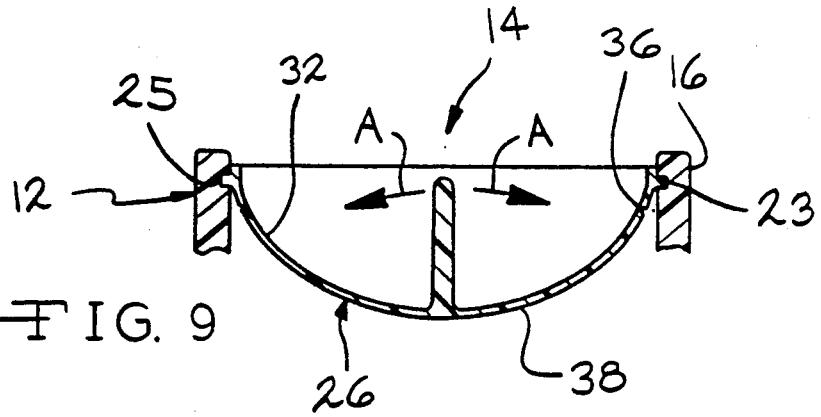
FIG. 9 is a sectional view taken substantially along line 9—9 in FIG. 8 and illustrates the closed position of the closure.
Figure 10:
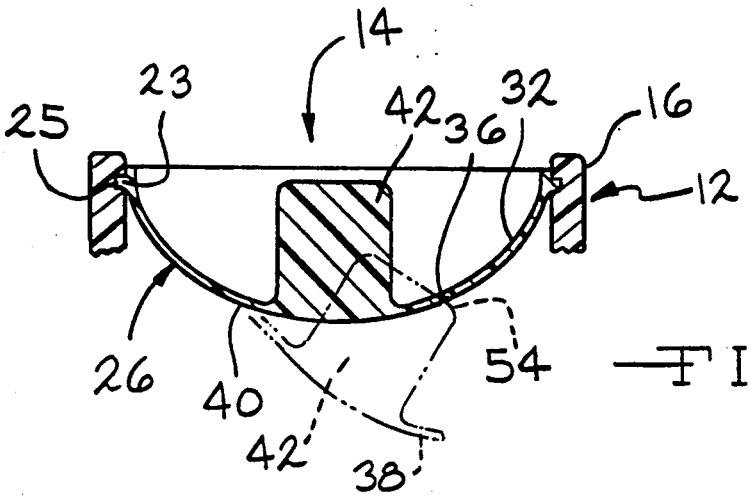
FIG. 10 is a sectional view taken substantially along line 10—10 in FIG. 8 and shows, in phantom, the third embodiment subsequently after opening of the container.

Another configuration for securing and sealing the cap 14 to the bottle 12 is shown in FIGS. 8, 9 and 10. In this embodiment, the cap utilizes an outwardly directed annular ring 23 which is circumferentially engaged and set within an annular groove 25 formed adjacent to and interiorly on the end of the mouth 16. The various sealing methods outlined above may also be used to seal the container 10 of this embodiment.

Each embodiment of the present invention incorporates an inverted structure 26 which is generally a recessed section of the cap 14 that extends in a direction interiorly of the container 10. While all involve the same general principles, the embodiments each illustrate a variation in shape and specific operation.

As mentioned, the inverted structure 26 can assume a variety of shapes. FIGS. 1-5 and 8-10 illustrate the inverted structure 26 as a concentric downwardly concave dome 32 being concentrically formed with the mouth 16. As clearly illustrated in FIGS. 1-5 and 8-10, the center section of the dome 32 is aligned with the mouth 16 and its outer edge or side is radially adjacent to the annular ring 24. In the embodiment of FIGS. 6 and 7, the inverted structure 26 is configured in the shape of a slanted wedge 34 positioned within a flat disc 35. Common to both the dome 32 and wedge 34 is that the inverted structures 26 extend generally interiorly, toward the cavity of the bottle 12, and include a tab 38.

A weakened area or score line 36 is formed in the surface of the inverted structure 26 and defines the tab 38. The score line 36 may be formed therein when the cap 14 is originally constructed or it may be stamped, coined or pressed into the surface of the cap 14 after initial construction. Additionally, the score line 36 can be formed in either the exterior or interior surface of the inverted structure 26 without affecting the container's operability.

In each embodiment, the tab 38 is not completely encircled by the score line 36. Rather, a tongue or connecting land or fixed end 40 connects the tab 38 to the remainder of the inverted structure 26.

A leverage member or actuator 42 is positioned so as to extend upwardly from the tab 38. To provide the container 10 with an increased stacking capability, the height of the leverage member 42 is limited so that it does not protrude past the uppermost portion of the container 10. Furthermore, the leverage member 42 is constructed of a thickness that will provide it with a substantial amount of rigidity.

In opening the container 10, finger pressure is applied onto the leverage member 42 so as to bend the leverage member back on the tab 38 (as generally shown by arrow A). During this bending, the tab 38 is flexed relative to the remainder of the inverted structure 26 and imparts a substantial amount of force onto the score line 36. With the score line 36 representing a weakened area of the cap 14, this inducement of force causes the score line 36 to fracture. Continued pressure on the leverage member 42 continues the fracturing of the score line 36. Once the score line 36 has been completely fractured, the tab 38 is connected to and maintained in a flexible relationship relative to the remainder of the inverted structure 26 by the tongue 40.

To facilitate the beginning of and the ease with which the score line 36 fractures, the geometry of the score line 36 is varied. A break or inflection 44 is provided in the curvature of the score line 36, at a position generally axial with the direction of tab 38 bending. Thus, fracturing of the score line 36 begins at the inflection 44. As seen in FIG. 8, the tab 38 may be provided with more than one inflection 44 thereby permitting the leverage member 42 to be bent in more than one direction to begin opening of the container 10. Also, the inflection 44 need not be specifically oriented with respect to the tongue 40 or to the remainder of the inverted structure 26.

With the score line 36 completely severed and the tongue 40 allowing the flexing of the now free end of the tab 38, downward finger pressure may be applied to the leverage member 42 (arrow B) thereby deflecting the tab 38 through an opening 46 defined in the center of the inverted structure 26 by the fractured score line 36 generally toward the interior of the container 10. The inward deflection of the tab 38 is continued until the leverage member 42 also passes through the opening 46. Once through the opening 46, the leverage member 42 is then urged in the direction of arrow C into an interference engagement with the interior surface of the inverted structure 26, generally at a position adjacent to the opening 46. In this manner, the leverage member 42 maintains the tab 38 in a spaced relation from the opening 46 and prevents the tab 38 from obstructing and closing the opening 46.

Once the leverage member 42 has been positioned in its interference or locked position, the contents of the container 10 may be consumed. Numerous structures can be provided on the cap 14 to facilitate the consumption of the contents. As seen in the FIGS. 2 through 5, the leverage member 42 is provided with a straw hole 48. Once the container 10 has been opened and the leverage member 42 engaged with the interior surface of the inverted structure 26, a straw 50 may be inserted through the straw hole 48. Alternatively, as seen in FIGS. 6 and 7, the leverage member 42 may be provided with a straw slot 52 instead of the straw hole 48.

While the above description constitutes the preferred embodiments of the present invention, it will be appreciated that the invention is susceptible to modification, variation and change without departing from the proper scope and fair meaning of the accompanying claims.

We claim:

1. A single service container adapted to be filled with a beverage that is to be consumed through a straw inserted into the container, said container comprising:

a hollow body having upright side walls defining a cavity and having an annular mouth formed at an upper end thereof;

a closure cap in sealing engagement with said mouth, said closure cap including a recessed portion being generally interiorly recessed toward said cavity, said recessed portion being positioned substantially concentrically with respect to said mouth and having a recessed center section and an outer edge section being located radially outwardly from said center section, a score line formed in said recessed portion and defining a tab having a free end and a fixed end, actuator means extending upwardly from said tab and being integrally formed therewith, said actuator means being manually operable to effect substantial separation of said tab from said recessed portion along said score line and said free end thereby defining and forming a container opening in said center section of said recessed portion of said closure cap, said fixed end of said tab being fixedly connected to said recessed portion in said outer edge section of said recessed portion and said free end extending into said center section, said tab being flexible through said container opening toward said cavity during substantial separation from said recessed portion, said actuator means being engageable with said recessed portion adjacent said score line so as to maintain said tab in a stable position depressed into said container cavity at a position below said container opening after substantial separation of said tab from said recessed portion, said actuator means having a straw opening formed therein, said straw opening in connection with said tab being fixedly connected at said outer edge section of said recessed portion enabling unobstructed access by straw through said container opening and said straw opening into said cavity.

2. A single service container as set forth in claim 1 wherein said recessed portion is a dome.

3. A single service container as set forth in claim 1 wherein said straw opening is a slot.

4. A single service container as set forth in claim 1 wherein said straw opening is an aperture.

* * * * *